US009801425B2

(12) United States Patent
Ahn et al.

(10) Patent No.: US 9,801,425 B2
(45) Date of Patent: Oct. 31, 2017

(54) HELMET SHIELD INCLUDING VENTILATION UNIT

(75) Inventors: Joong Koo Ahn, Gyeonggi-do (KR); Young Il Kim, Gyeonggi-do (KR); Chang Seob Lee, Gyeonggi-do (KR)

(73) Assignee: HJC CORP., Gyeonggi-do (KR)

( * ) Notice: Subject to any disclaimer, the term of this patent is extended or adjusted under 35 U.S.C. 154(b) by 991 days.

(21) Appl. No.: 13/179,659

(22) Filed: Jul. 11, 2011

(65) Prior Publication Data

US 2012/0011641 A1 Jan. 19, 2012

(30) Foreign Application Priority Data

Jul. 19, 2010 (KR) ..... 10-2010-0069691

(51) Int. Cl.
*A42B 3/24* (2006.01)
*G02C 11/08* (2006.01)

(52) U.S. Cl.
CPC ..... *A42B 3/24* (2013.01)

(58) Field of Classification Search
CPC .. A42B 3/26; A42B 3/24; A42B 3/226; A42B 3/185; A42B 1/043; A42B 3/245; G02C 7/16; G02C 1/06; G02C 7/12; G02C 9/00; G02C 11/12; G02C 7/02; G02C 11/08; G02C 2200/02; G02C 2200/04; G02C 7/086; G02C 9/04; G02C 5/001; G02C 11/00; G02C 1/00; G02C 1/04; G02C 5/00; G02C 5/008; G02C 5/143; G02C 5/2263; G02C 7/083; G02C 7/101; G02C 7/104
USPC ..... 2/434, 15, 435, 424, 436
See application file for complete search history.

(56) References Cited

U.S. PATENT DOCUMENTS

| | | | | | |
|---|---|---|---|---|---|
| 4,435,852 | A * | 3/1984 | Nesler | 2/436 | |
| 4,498,202 | A * | 2/1985 | Yamamoto | 2/424 | |
| RE32,638 | E * | 4/1988 | Nesler | 2/436 | |
| 5,394,566 | A * | 3/1995 | Hong | 2/424 | |
| 5,671,483 | A * | 9/1997 | Reuber | 2/424 | |
| 5,694,650 | A * | 12/1997 | Hong | 2/424 | |
| 6,138,285 | A * | 10/2000 | Robrahn et al. | 2/436 | |
| 6,405,373 | B1 * | 6/2002 | Grau | 2/15 | |
| 6,792,951 | B2 * | 9/2004 | Evonitz, III | 128/857 | |
| 7,641,333 | B2 * | 1/2010 | Blanshay | A61F 9/025 | 351/47 |
| 8,695,121 | B2 * | 4/2014 | Nolan et al. | 2/171.3 | |
| 2007/0011797 | A1 * | 1/2007 | Ikeda | 2/424 | |
| 2007/0113324 | A1 * | 5/2007 | Chen | 2/424 | |
| 2007/0182916 | A1 * | 8/2007 | Blanshay | A61F 9/025 | 351/62 |
| 2010/0095439 | A1 * | 4/2010 | Nolan et al. | 2/421 | |
| 2011/0231977 | A1 * | 9/2011 | Rupnick et al. | 2/7 | |

* cited by examiner

*Primary Examiner* — Alissa L Hoey
*Assistant Examiner* — Catherine M Ferreira
(74) *Attorney, Agent, or Firm* — Amin, Turocy & Watson LLP

(57) ABSTRACT

A helmet shield coupled to a front opening of a helmet includes a lens unit provided to face a front of the front opening; a frame unit provided along a circumference of the lens unit; and a ventilation unit provided at both sides of the lens unit for communication between an inside and an outside of the helmet shield.

6 Claims, 13 Drawing Sheets

HELMET SHIELD INCLUDING VENTILATION UNIT

FIELD OF THE INVENTION

The present disclosure relates to a helmet shield. To be specific, the present disclosure relates to a shield installed outside a front opening of a helmet.

BACKGROUND OF THE INVENTION

A rider is necessarily required to wear a helmet when riding a two-wheeled vehicle such as a motorcycle, and a retractable shield may be installed at a front opening of a helmet main body to allow a helmet wearer to obtain a front view.

Generally, a shield exposed to the outside of a helmet is made of plastic to allow a helmet wearer to obtain a front view and to readily open and close the shield. If a surface of the shield is damaged or scratched by foreign substances or the like, the shield is replaced or a shield protective film is attached on the shield in order to obtain a clear view according to conventional techniques.

A helmet has a hermetically sealed structure where little air can get in or get out, which makes a helmet wearer easily feel it is stuffy inside the helmet. Further, the inside of a shield can be steamed due to humidity caused by the helmet wearer's breathing, and, thus, the helmet wearer's view may be blocked. In order to solve these problems, there has been suggested a helmet including a retractable ventilation unit on each of a front side and a rear side of a helmet main body. With this configuration, air outside the helmet can flow into the helmet and circulate in the helmet and then flow out through the rear side of the helmet main body.

However, generally, a helmet main body is fastened to a helmet wearer's head for safety, and thus, air flowed into through a front side of the helmet cannot flow out smoothly.

BRIEF SUMMARY OF THE INVENTION

In order to solve the above-described problems, the present disclosure provides a helmet shield including a ventilation unit.

In view of the foregoing, in accordance with an embodiment of the present disclosure, there is provided a helmet shield coupled to a front opening of a helmet. The helmet shield includes a lens unit provided to face a front of the front opening; a frame unit provided along a circumference of the lens unit; and a ventilation unit provided at both sides of the lens unit for communication between an inside and an outside of the helmet shield.

In accordance with the present disclosure, air inside a shield can flow out of the shield smoothly.

Further, in accordance with the present disclosure, if the inside of the shield communicates with the outside of the shield, it is possible to prevent a helmet wearer's view from being blocked by steam.

BRIEF DESCRIPTION OF THE DRAWINGS

Non-limiting and non-exhaustive embodiments will be described in conjunction with the accompanying drawings. Understanding that these drawings depict only several embodiments in accordance with the disclosure and are, therefore, not to be intended to limit its scope, the disclosure will be described with specificity and detail through use of the accompanying drawings, in which.

DETAILED DESCRIPTION OF THE INVENTION

Figure 1:
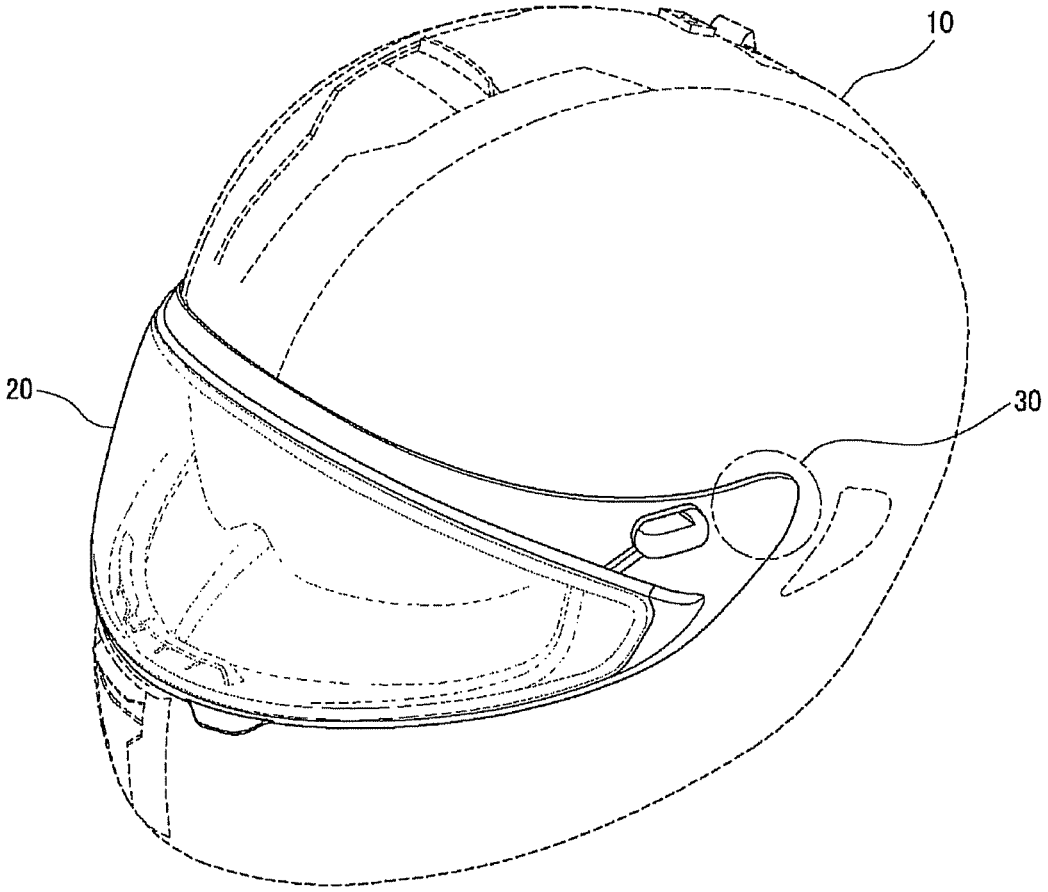
FIG. 1 is a perspective view of a helmet equipped with all components in accordance with an embodiment of the present disclosure.

Hereinafter, embodiments of the present disclosure will be described in detail with reference to the accompanying drawings so that the present disclosure may be readily implemented by those skilled in the art. However, it is to be noted that the present disclosure is not limited to the embodiments but can be realized in various other ways. In the drawings, parts irrelevant to the description are omitted for the simplicity of explanation, and like reference numerals denote like parts through the whole document.

Through the whole document, the term "connected to" or "coupled to" that is used to designate a connection or coupling of one element to another element includes both a case that an element is "directly connected or coupled to" another element and a case that an element is "electronically connected or coupled to" another element via still another element. Further, the term "comprises or includes" and/or "comprising or including" used in the document means that one or more other components, steps, operation and/or existence or addition of elements are not excluded in addition to the described components, steps, operation and/or elements.

FIG. 1 is a perspective view of a helmet equipped with all components in accordance with an embodiment of the present disclosure.

As depicted in FIG. 1, a helmet in accordance with an embodiment of the present disclosure may include a helmet main body 10 and a shield 20.

In the helmet in accordance with the embodiment of the present disclosure, the shield 20 may be configured to be detachably attached to the helmet main body 10. FIG. 1 shows that the shield 20 is attached to the helmet main body 10.

To be specific, the helmet main body 10 may have a front opening at its front side and may be formed in a cap shape to be worn on a helmet wearer's head. Further, the main body 10 may be provided with the shield 20 at its both sides and may include a part of rotational connection units configured to control opening/closing or a degree of rotation of the shield 20.

The shield 20 may be configured to obtain a front view despite wind introduced through the front and prevent difficulty in breathing while riding a motorcycle by opening/closing the front opening of the helmet main body 10. The shield 20 may include a part of the rotational connection units 30 capable of opening/closing the shield 20 from a front top of the helmet main body 10 in up and down directions (i.e. Y-axis direction). Extended sides of the shield 20 may be coupled to both sides of the helmet main body 10 and may be connected to the helmet main body 10 by the rotational connection units 30.

The shield 20 in accordance with the present disclosure may include a unit for communication between the inside and outside of the shield 20, and a unit for preventing condensation on an inner surface of the shield 20. A configuration of the shield 20 will be explained in detail by reference to FIGS. 2 to 6B.

Figure 2:
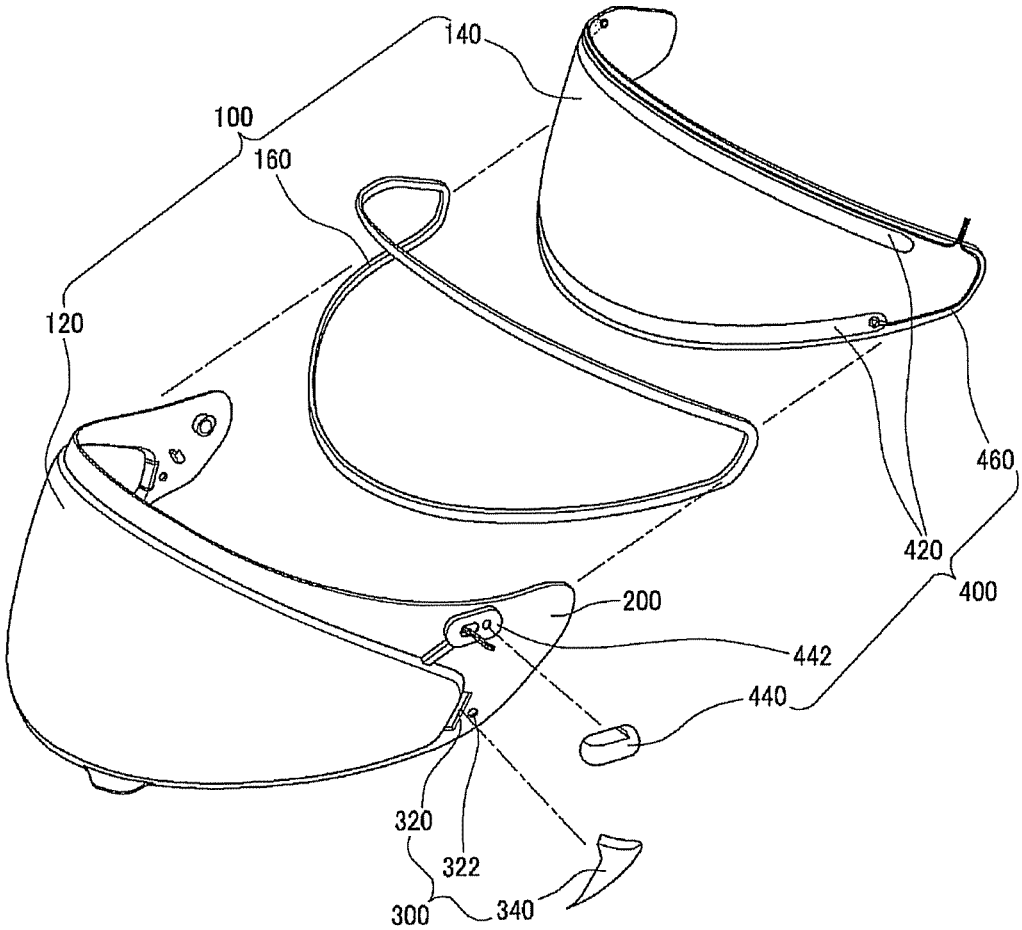
FIG. 2 is an exploded perspective view of a shield in accordance with the embodiment of the present disclosure.

FIG. 2 is an exploded perspective view of a shield in accordance with the embodiment of the present disclosure.

As depicted in FIG. 2, the shield 20 in accordance with the embodiment of the present disclosure may include a lens unit 100 positioned to face a front side of the front opening of the helmet; a frame unit 200 provided along a circumference of the lens unit 100; a ventilation unit 300 for communication between the inside and outside of the shield 20; and a heat transfer unit 400 for preventing condensation on a surface of the lens unit 100.

The lens unit 100 may be positioned to face the front side of the front opening of the helmet. The lens unit 100 may be made of a transparent material in order for a helmet wearer to obtain a view. The lens unit 100 may have a non-uniform thickness throughout the lens unit 100. By way of example, the lens unit 100 may be the thickest in a central region and may become thinner in a direction toward an edge thereof. In this case, distortion of light passing through the lens unit 100 can be reduced.

The lens unit 100 may include, but is not limited to, double lenses as depicted in FIG. 2, and may include one single lens or multiple lenses. Further, the lens unit 100 in accordance with the embodiment of the present disclosure may be protruded from the frame unit 200 toward the front of the shield 20 by a certain length. The lens unit 100 will be explained in detail by reference to FIGS. 4A and 4B.

The frame unit 200 may be provided along the circumference of the lens unit 100. The frame unit 200 may provide a frame for coupling the lens unit 100 to the helmet main body 10, and may be configured as one single body with the lens unit 100. Therefore, the frame unit 200 may be made of, but not limited to, a transparent material in the same manner as the lens unit 100.

The frame unit 200 in accordance with the embodiment of the present disclosure may include a subordinate device to support the lens unit 100. By way of example, the frame unit 200 may include a part of the ventilation unit 300 for communication between the inside and outside of the shield 20 and may include a part of the heat transfer unit 400 for preventing condensation on the lens unit 100.

The ventilation unit 300 may be configured for communication between the inside and outside of the shield 20 and will be explained in detail by reference to FIGS. 2 and 3A to 3C.

Figure 3A:
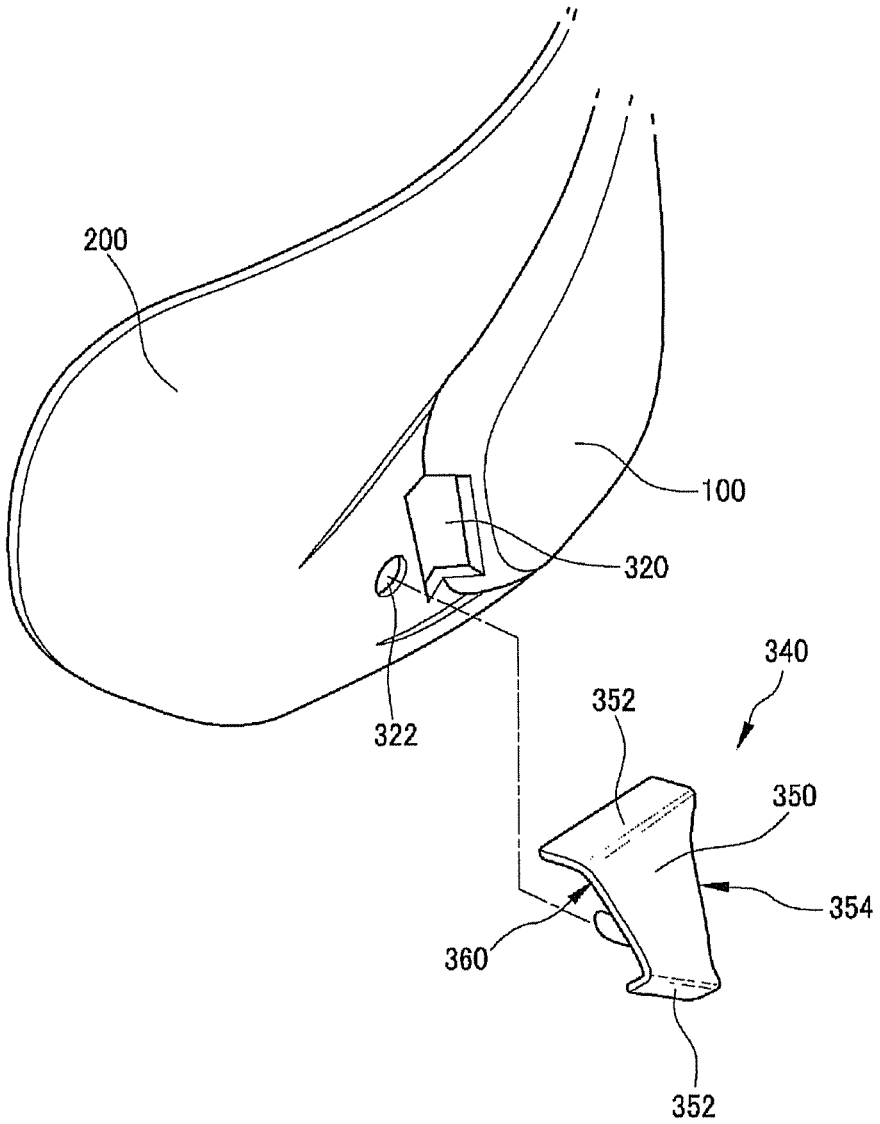
FIGS. 3A to 3C are provided to explain a ventilation unit of the shield in accordance with the embodiment of the present disclosure.
Figure 3B:
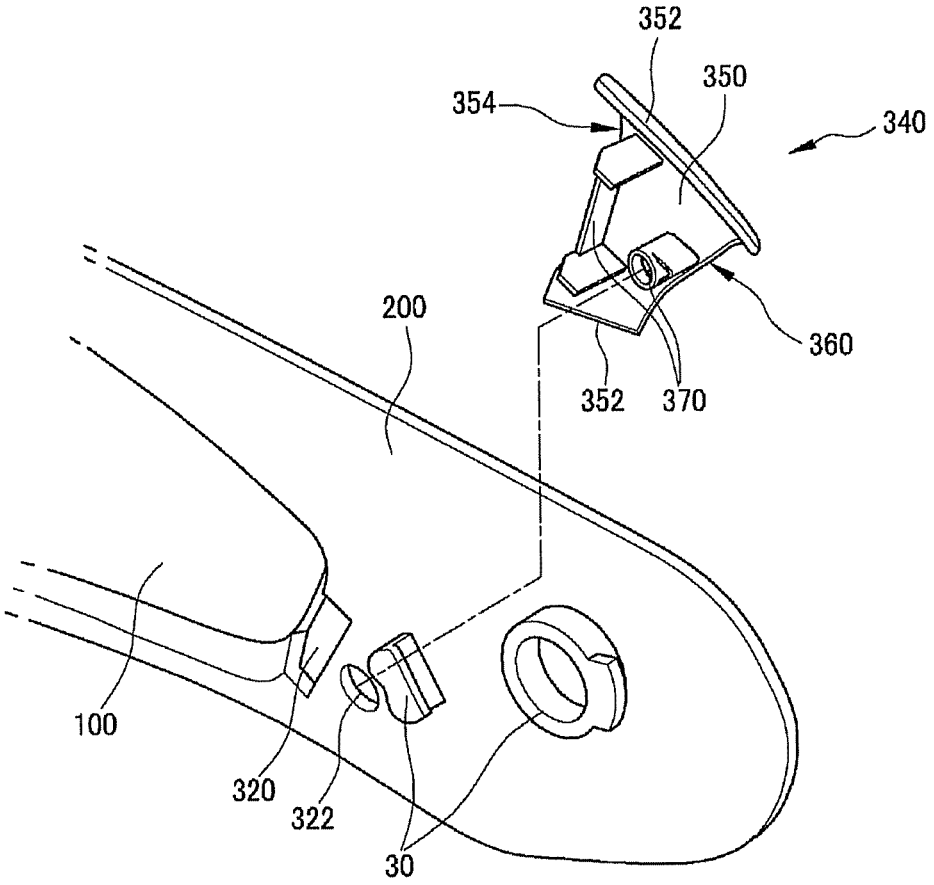
Figure 3C:
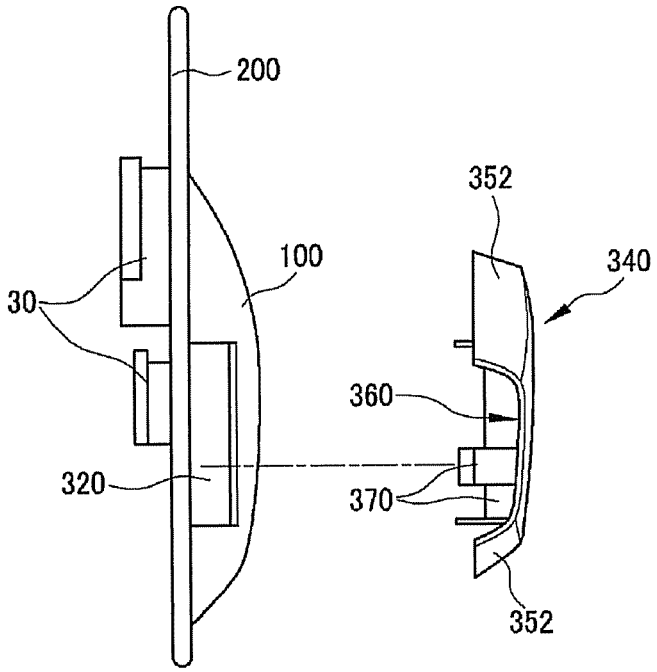

FIGS. 3A to 3C are provided to explain a ventilation unit of the shield in accordance with the embodiment of the present disclosure.

The ventilation unit 300 may be provided at both sides of the lens unit 100. The ventilation unit 300 may be positioned to be connected to both sides of the lens unit 100 or may be provided at a certain distance from the lens unit 100. Further, the ventilation unit 300 may be of multiple devices functioning the same.

The ventilation unit 300 may include a ventilation hole 320 and a guide unit 340. The guide unit 340 is configured to cover a ventilation hole 320.

The ventilation hole 320 may be formed by removing a part of the shield 20. The inside and outside of the shield may be communicated with each other through the ventilation hole 320. The ventilation hole 320 may be formed at a certain position in a certain shape. Desirably, the ventilation hole 320 may be formed so as not to prevent an air flow between the inside and outside of the shield 20. The ventilation hole 320 may be formed by etching the equipped shield 20 or by injection-molding the shield 20 having the ventilation hole 320.

The ventilation hole 320 in accordance with the embodiment of the present disclosure may be formed such that at least a part of the ventilation hole 320 faces a rear outside of the shield 20. By way of example, if the lens unit 100 protrudes from the frame unit 200 toward the front of the shield 20, the ventilation hole 320 may be formed by consecutively removing a part of the lens unit 100 and a part of the frame unit 200 at a boundary between the lens unit 100 and the frame unit 200. A part of the ventilation hole 320 formed by removing a side of the lens unit 100 may be formed so as to face the rear outside of the shield 20 and another part of the ventilation hole 320 formed by removing the part of the frame unit 200 may be formed so as to face a vertical direction. If the ventilation hole 320 is formed so as to face the rear outside of the shield 20, the helmet wearer may not be influenced by wind applied to the front of the shield 20, and air inside the shield 20 can flow out of the shield 20 smoothly.

The guide unit 340 may be coupled to an outer surface of the shield 20 in an outside direction of the ventilation hole 320. To be specific, the guide unit 340 may include a cover unit 350 provided at a distance from the ventilation hole 320 to cover the ventilation hole 320 and a guide hole 360 for communication between the ventilation hole 320 and the rear outside of the shield 20. The guide unit 340 may be coupled to the frame unit 200 by one or more fixing rings 370.

The cover unit 350 may serve as a main body of the guide unit 340, and may be connected to the frame unit 200 and the lens unit 100. The cover unit 350 may include frame unit connectors 352 provided at its upper side and lower side for connection to the frame unit 200. The frame unit connectors 352 may be formed in a predetermined support shape so as to keep the guide unit 340 away from the shield 20. The frame unit connectors 352 may be of, but not limited to, a uniform height. Further, the frame unit connectors 352 may support the cover unit 350 and also may subserve communication of the ventilation hole 320 in a predetermined direction. If the air inside the shield 20 flows out of the shield 20 through the ventilation hole 320, the air flow may be blocked so as not to flow out in an upward or downward direction of the cover unit 350.

The cover unit 350 may include a lens unit connector 354 for connection to the lens unit 100. The lens unit connector 354 may be connected to a side edge of the lens unit 100. If the lens unit 100 protrudes as depicted in FIGS. 3A to 3C, the lens unit connector 354 may be not necessarily formed in a support shape. However, if the lens unit 100 does not protrude, the lens unit connector 354 may be formed to have a certain height in the same manner as the frame unit connectors 352. The lens unit connector 354 may support the cover unit 350 by connection to the lens unit 100. Further, in the same manner as the frame unit connectors 352, the lens unit connector 354 may block a flow of the air inside the shield 20 flowed out through the ventilation hole 320 for communication in a certain direction.

The cover unit 350 in accordance with the embodiment of the present disclosure may be formed so as to be extended smoothly from the lens unit 100. In order to do so, the lens unit connector 354 may have the same height as the lens unit 100's side surface connected to the lens unit connector 354. Further, the lens unit connector 354 may have the same width as the lens unit 100's side surface connected to the lens unit connector 354. Since an air flow on an outer surface of the shield 20 moves from the lens unit 100 toward the guide unit 340, it is desirable to form the cover unit 350 to be extended smoothly from the lens unit 100 so as not to block the air flow.

The guide hole 360 may be formed by opening an edge of the cover unit 350, and may be limited by the frame unit 200 and the cover unit 350. The guide hole 360 may be formed at a rear outside of the guide unit 340 for communication of the ventilation hole 320 toward the rear outside. A shape of the guide hole 360 may be determined by the cover unit 350, and may be of any shape for easily releasing the air inside the shield 20 to the outside of the shield 20.

The guide unit 340 may include one or more fixing rings 370 for coupling the guide unit 340 to the frame unit 200. The fixing ring 370 may be inserted into the ventilation hole 320 and fixed thereto, or may be inserted into a hole formed separately from the ventilation hole 320 and fixed thereto. In this case, the ventilation unit 300 may include a fixing hole 322 formed, separately from the ventilation hole 320, by removing a part of the frame unit 200. Further, when the fixing ring 370 is inserted into the fixing hole 322, the inserted fixing ring 370 may be screwed by a screw or the like so as to be securely fixed to the frame unit 200.

A width of the lens unit 100 may be narrower toward its side edge. In the same manner, a width of the cover unit 350 connected to the side surface of the lens unit 100 may be formed to be narrower toward the guide hole 360 in order for air flowing outside the lens unit 100 to smoothly flow through an upper end of the cover unit 350.

Hereinafter, the lens unit 100 will be explained in detail by reference to FIGS. 2, 4A and 4B.

Figure 4A:
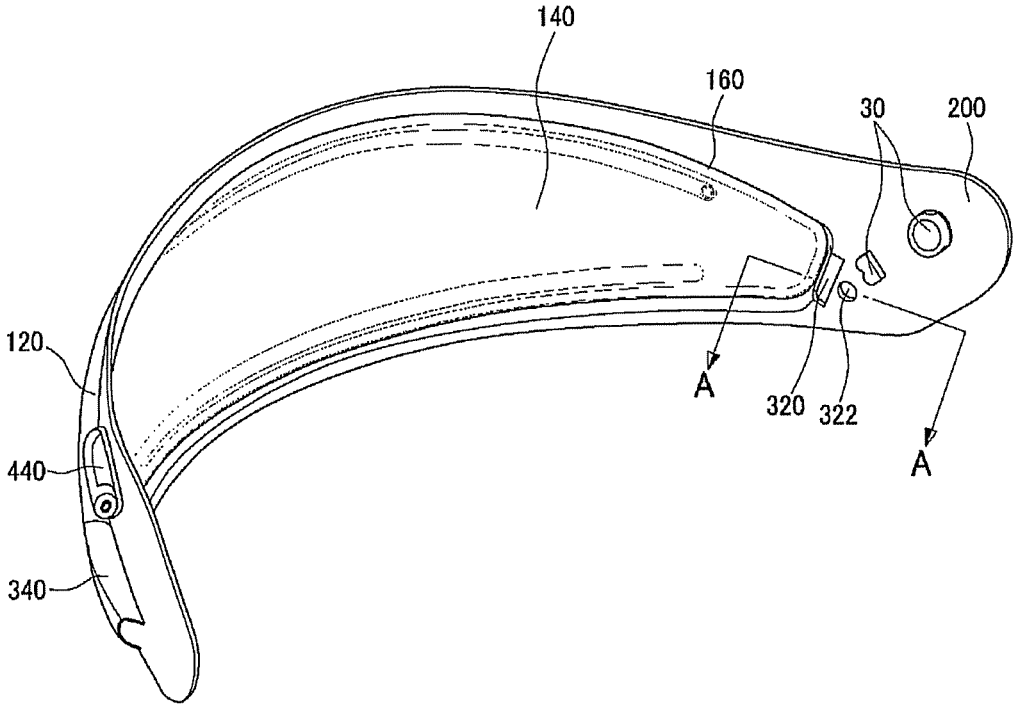
FIGS. 4A and B are provided to explain a lens unit of a shield in accordance with the embodiment of the present disclosure.
Figure 4B:
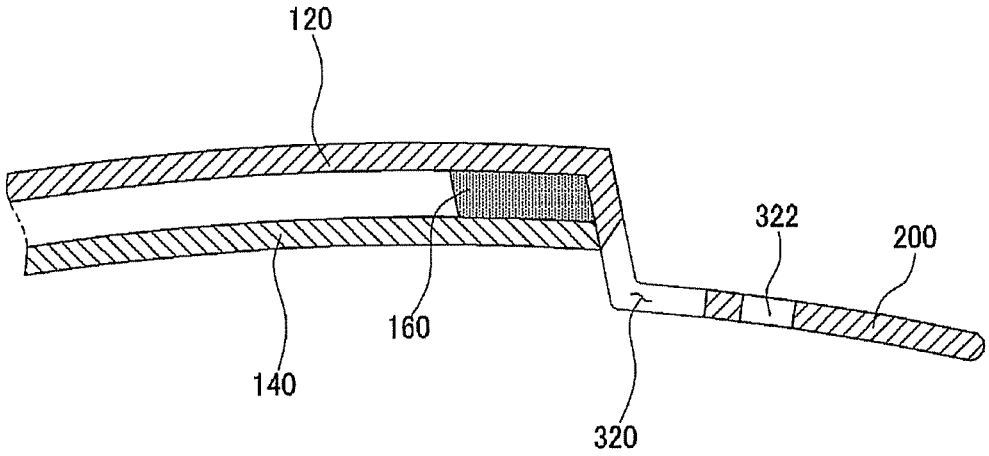

FIG. 4A is a perspective view and FIG. 4B is a cross-sectional view to explain a lens unit of a shield in accordance with an embodiment of the present disclosure.

The lens unit 100 may include a first lens unit 120 configured as one single body with the frame unit 200 and a second lens unit 140 coupled in an inside direction with respect to the first lens unit 120. The second lens unit 140 may be coupled to the first lens unit 120 at a certain distance from the first lens unit 120 so as to form an air gap between the first lens unit 120 and the second lens unit 140.

The first lens unit 120 may be formed outside the shield 20, and may be protruded from the frame unit 200 toward the front of the shield 20 in other embodiments of the present disclosure. Desirably, the first lens unit 120 may be made of a transparent material. Further, desirably, the first lens unit 120 may be made of a material averagely thicker than a material of the second lens unit 140 in order to resist an external force.

The second lens unit 140 may be coupled in the inside direction with respect to the first lens unit 120. The second lens unit 140 may be provided independently from the frame unit 200, and may be antifog-treated. An antifog-treatment is carried out to prevent the second lens unit 140 from being steamed due to humidity caused by the helmet wearer's breathing. Further, the second lens unit 140 may protect a rider's eyes by blocking direct sunlight from getting into the rider's eyes during the daytime. Further, the second lens unit 140 may be made of plastic capable of blocking light in order for the rider to obtain a clear view despite strong sunlight or reflected light.

The second lens unit 140 may be made of a material relatively thinner than that of the first lens unit 120. Further, the second lens unit 140 may have identical or similar size, shape, curve, transparency to those of the first lens unit 120, but they may vary in other embodiments.

The second lens unit 140 may be coupled in the inside direction of the first lens unit 120. The first lens unit 120 and the second lens unit 140 may be directly coupled to each other by using a connecting member 480, or may be indirectly coupled to each other by using a buffering member as depicted in FIGS. 4A and 4B.

A buffering member may be interposed between the first lens unit 120 and the second lens unit 140, and may support and connect the first lens unit 120 and the second lens unit 140. The buffering member 160 may be provided along a circumference of the first lens unit 120 and second lens unit 140. The buffering member 160, the first lens unit 120 and the second lens unit 140 may be securely connected and fixed to one another by an adhesive material.

Desirably, the buffering member 160 in accordance with the embodiment of the present disclosure may be made of transparent or translucent material so as not to block a helmet wearer's view. Further, desirably, the buffering member 160 may be made of a compressible material. When the second lens unit 140 is coupled to the inside of the first lens unit 120 through the buffering member 160, if a vacuum state is made between the first lens unit 120 and the second lens unit 140 for a while, the connecting between the first lens unit 120 and the second lens unit 140 can be more securely maintained.

The connection between the first lens unit 120 and the second lens unit 140 may form an air gap therebetween. The air gap may be confined and sealed by the first lens unit 120, the second lens unit 140 and the buffering member 160. A thickness of the air gap may be determined by a height of the buffering member 160. As depicted in FIG. 4B, desirably, the buffering member 160 may have a height that does not allow the second lens unit 140 to block the ventilation hole 320. If the buffering member 160 has a too great height and blocks an inside surface of the ventilation hole 320, it may be difficult for the air inside the shield 20 to be released to the outside of the shield 20.

The sealed air gap may maintain thermal characteristics of the lens unit 100. By way of example, if the temperature is low, the sealed air gap may prevent condensation of steam on the surface of the lens unit 100.

Referring to FIG. 4B, the second lens unit 140 may be positioned in an outside direction of the shield 20 as compared with the frame unit 200. That is, the buffering member 160 and the second lens unit 140 may be thinner than the protruding first lens unit 120. In this case, the ventilation hole 320 positioned at a side of the first lens unit 120 may be provided along an inner surface of the second lens unit 140. In this case, air flowing through the second lens unit 140 can be released easily to the outside of the ventilation hole 320.

Figure 5A:
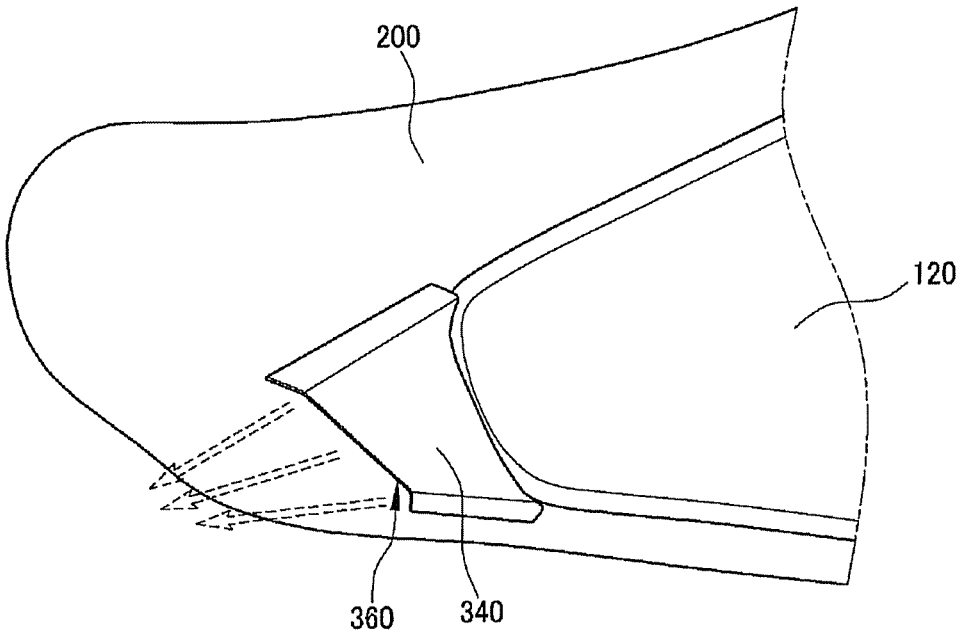
FIGS. 5A to 5C are provided to explain a flow of air in and out of a shield in accordance with the embodiment of the present disclosure.
Figure 5B:
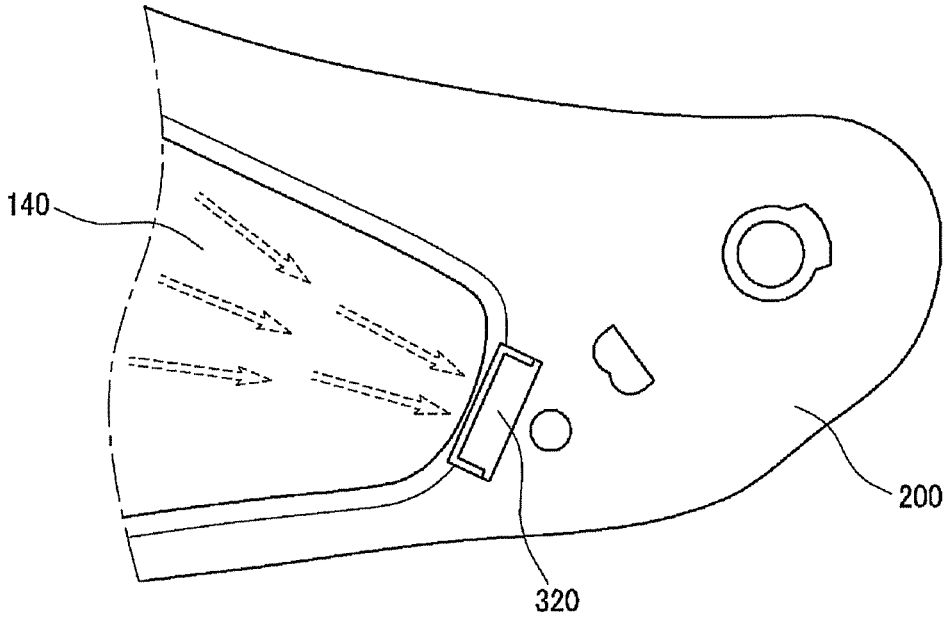
Figure 5C:
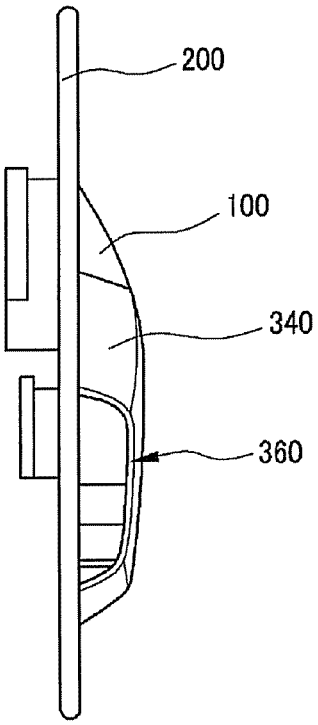

FIGS. 5A to 5C are provided to explain an air flow in and out of a shield in accordance with an embodiment of the present disclosure.

Generally, the shield 20 may have a shape curved in a longitudinal direction in order to reduce air resistance. When a helmet wearer drives, air outside the shield 20 may move from side to side along a surface of the shield 20. The air moving along the outer surface of the shield 20 may be faster as it goes to the side.

According to Bernoulli's theorem, a fluid pressure may be decreased when a fluid speed is high, and the fluid pressure may be increased when the fluid speed is low.

Therefore, an air pressure at the side of the shield 20 may be lower than an air pressure inside the shield 20. Thus, the air inside the shield 20 can be released to the outside through the ventilation unit 300 provided at the side of the shield 20.

Hereinafter, referring to FIGS. 5A to 5C, an air flow released through the ventilation unit 300 will be explained.

The air inside the shield 20 may move from side to side along the second lens unit 140. Generally, the air inside the shield 20 is generated by the helmet wearer's breathing, and, thus, it may move from side to side along the second lens unit 140. Particularly, since the second lens unit 140 further protrudes toward the front of the shield 20 as compared with the frame unit 200, the air inside the shield 20 may move through an inner surface of the second lens unit 140 rather than the frame unit 200.

Then, the air moving through the second lens unit 140 may pass through the ventilation hole 320. Since at least a part of the ventilation hole 320 faces the rear outside of the shield 20, the air moving through the second lens unit 140 may pass through the ventilation hole 320.

Thereafter, the air passing through the ventilation hole 320 may pass through the guide hole 360. Since the guide hole 360 is provided so as to face the rear outside, the air passing through the guide hole 360 may meet with the air outside the shield 20. The guide unit 340 may prevent turbulence outside the ventilation hole 320 of the shield 20, and, thus, the air released to the outside of the shield 20 cannot flow back to the inside of the ventilation hole 320. Desirably, the guide hole 360 may be relatively narrower than the ventilation hole 320 in order to easily release air.

If the inside and outside of the shield 20 communicate with each other, steam released by the helmet wearer's breathing can be released easily to the outside of the shield 20. Further, it is possible to prevent a helmet wearer's view from being blocked by steam.

Figure 6A:
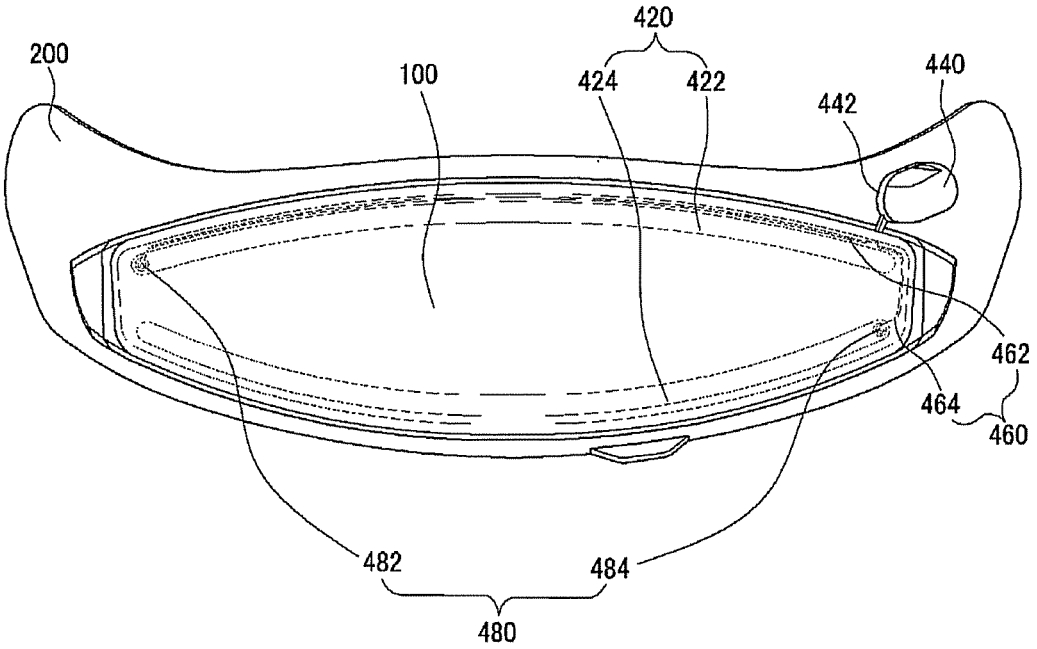
FIGS. 6A to 6C are provided to explain a heat transfer unit in accordance with the embodiment of the present disclosure.
Figure 6B:
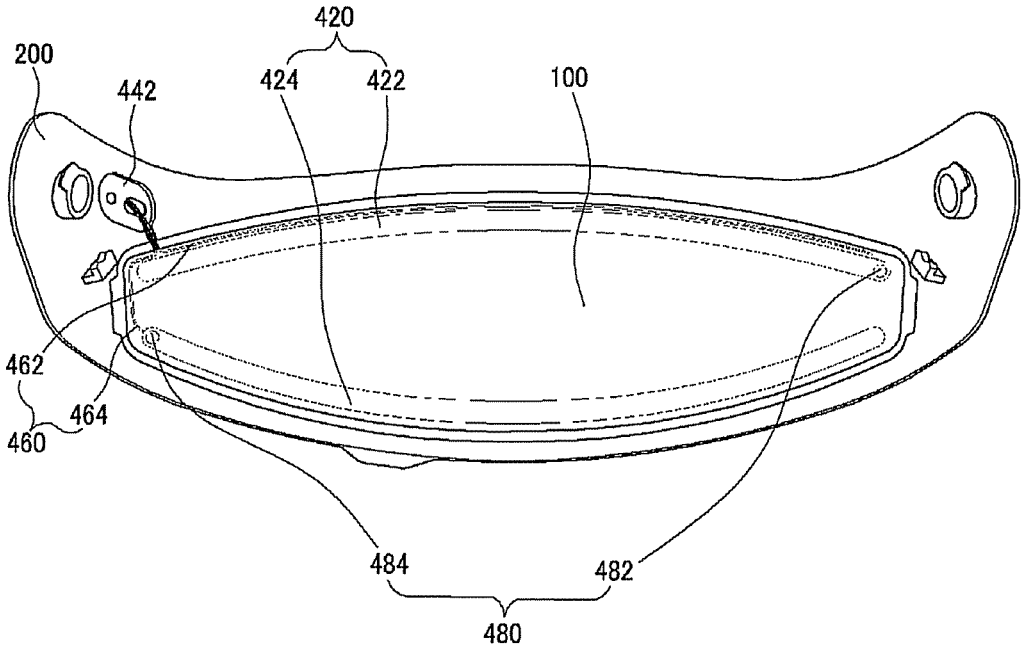
Figure 6C:
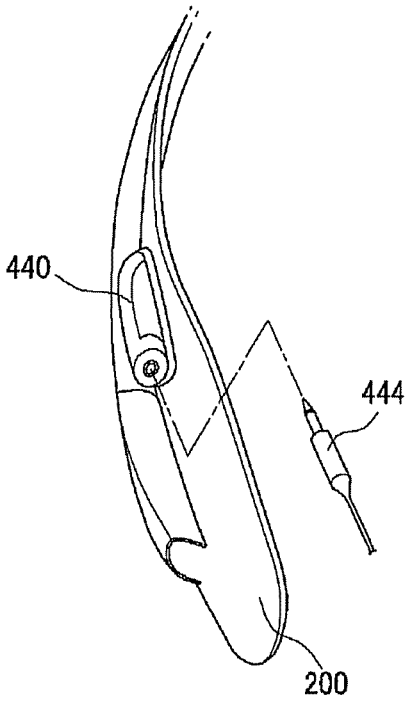

FIGS. 6A to 6C are provided to explain a heat transfer unit in accordance with the embodiment of the present disclosure. Referring to FIGS. 2, 6A, 6B and 6C, the heat transfer unit 400 will be explained.

The shield 20 may include the heat transfer unit 400 for generating heat to prevent condensation on the surface of the lens unit 100. If condensation occurs on the surface of the lens unit 100, the helmet wearer may not obtain a view. Therefore, the shield 20 may include the heat transfer unit 400 for generating heat to prevent condensation.

To be specific, the heat transfer unit 400 may include, as depicted in FIGS. 6A and 6B, a heat transfer line 420 supplied with power and generating heat; a power input unit 440 transferring power to the heat transfer line 420; and an electric wire 460 electrically connecting the heat transfer line 420 with the power input unit 440.

The heat transfer line 420 may be provided in an inner surface of the first lens unit 120 or in an outer surface of the second lens unit 140, and one or more heat transfer lines 420 may be provided at an edge along a circumference thereof. In an embodiment, the heat transfer line 420 may include a first heat transfer line 422 provided at an upper edge of the first lens unit 120 or second lens unit 140 along a circumference; and a second heat transfer line 424 provided at an lower edge of the second lens unit 140. Desirably, the first heat transfer line 422 and the second heat transfer line 424 may be provided inside the buffering member 160. That is because the heat transfer line 420 generates heat and the buffering member 160 may be deformed or combusted due to overheating of the heat transfer line 420. The heat transfer line 420 may prevent condensation of steam on the surfaces of the first lens unit 120 and second lens unit 140 by generating heat.

The power input unit 440 may be provided on the frame unit 200. The power input unit 440 may transfer power, and may include, at its side, a power connector 444 to be supplied with power from a power generation source. The power generation source may be included in the helmet main body 10. An end of the power connector 444 may be connected to the power generation source and the other end may be inserted into the power input unit 440 for transferring power. The power connector 444 may be inserted into the power input unit 440 in a rear outside direction of the power input unit 440, but not limited thereto, in consideration of air resistance. However, in other embodiments, the shield 20 may not include the power input unit 440, or may be configured as one single body with the power input unit 440. Further, referring to FIGS. 6A and 6B, the power input unit 440 may be provided on the frame unit 200, but not limited thereto.

The frame unit 200 may further include a power input connection unit 442 connected with the power input unit 440 as depicted in FIG. 2. The power input connection unit 442 may be protruded from the frame unit 200 toward the outside by a certain length. Further, the power input connection unit 442 may be provided at a certain distance from an upper side of the lens unit 100, but not limited thereto.

A surface of the power input unit 440 in accordance with the embodiment of the present disclosure may be connected to the power input connection unit 442. The power input connection unit 442 may include a hole for fixing the power input unit 440. In this case, the power input connection unit 442 may further include a clamping device configured to pass through the inside and outside of the hole. Thus, the power input connection unit 442 can securely fix the connection between the power input unit 440 and the power input connection unit 442.

A surface of the power input unit 440 may be connected to the electric wire 460 configured to transfer power to the heat transfer line 420. After the power input unit 440 is connected to the power input connection unit 442, the electric wire 460 may be extended in an inside direction of the first lens unit 120, such that a surface of the power input connection unit 442 may further include a hole for communication with the electric wire 460. The electric wire 460 may connect the power input unit 440 with the heat transfer line 420 through the hole. Therefore, multiple electric wires 460 may be provided depending on the number of the heat transfer line 420. In the embodiment, the electric wire 460 may include a first electric line 462 for connecting the first heat transfer line 422 with the power input unit 440; and a second electric wire 464 for connecting the second heat transfer line 424 with the power input unit 440. The power input unit 440 may be provided on the frame unit 200, and the heat transfer line 420 may be provided on an outer surface of the second lens unit 140. Therefore, the power input connection unit 442 may include a hole for a connection between the power input unit 440 and the heat transfer line 420 in other embodiments as described above. Further, desirably, the electric wire 460 may be provided along an edge of the second lens unit 140 so as not to block the helmet wearer's view. In the embodiment, the electric wire 460 may be positioned between the buffering member 160 and the heat transfer line 420.

The heat transfer unit 400 in accordance with the embodiment of the present disclosure may include a connecting member 480 configured to electrically connect the electric wire 460 with the heat transfer line 420. The connecting member 480 may be made of an insulating material in order to connect an end of the electric wire 460 with an end of the heat transfer line 420. Multiple connecting members 480 may be provided depending on the number of the heat transfer line 420. In the embodiment, the connecting member 480 may include a first connecting member 482 for connecting the first heat transfer line 422 with the first electric wire 462; and a second connecting member 484 for connecting the second heat transfer line 424 with the second electric wire 464. The connecting member 480 may have a certain shape for connecting the heat transfer line 420 with the electric wire 460. In the embodiment, the connecting member 480 may be provided so as to penetrate the second lens unit 140. Further, the connecting member 480 may be provided such that an end of the connecting member 480 connects the heat transfer line 420 provided on the second lens unit 140 and an end of the electric wire 460.

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure. For example, each component described to be of a single type can be implemented in a distributed manner. Likewise, components described to be distributed can be implemented in a combined manner.

The scope of the present disclosure is defined by the following claims rather than by the detailed description of the embodiment. It shall be understood that all modifications and embodiments conceived from the meaning and scope of the claims and their equivalents are included in the scope of the present disclosure.

What is claimed is:

1. A helmet shield coupled to a front opening of a helmet, the helmet shield comprising:

a lens unit provided to face a front portion of the front opening;

a frame unit provided along a perimeter of the lens unit; and a ventilation unit provided at distal ends of the lens unit, the ventilation unit providing for fluid communication of air between an inside and an outside of the helmet shield, wherein the ventilation unit includes: a ventilation hole, and a guide unit coupled to an outer surface of the helmet shield to cover the ventilation hole;

wherein the lens unit includes:

a first lens configured as one single body with the frame unit, the first lens protrudes from the frame unit toward a front of the helmet shield, and a second lens coupled in an inside direction with respect to the first lens, the second lens further protrudes toward a front of the helmet shield with respect to the frame unit, wherein the ventilation hole is located through a part of the first lens and a part of the frame unit at a boundary between the first lens and the frame unit, and wherein a first part of the ventilation hole through the first lens faces a rear outside of the helmet shield along an inner surface of the second lens and a second part of the ventilation hole through the part of the frame unit faces a vertical direction with respect to the helmet shield, and wherein the guide unit includes:

a cover unit provided at a distance from the ventilation hole to cover the ventilation hole;

a guide hole formed at a rear outside of the cover unit for fluid communication of air between the ventilation hole and the rear outside of the helmet shield;

a lens unit connector configured to connect the cover unit to a side edge of the lens unit; and a fixing ring provided at the cover unit for coupling the cover unit and the frame unit, the fixing ring configured to be inserted into a fixing hole formed, separately from the ventilation hole, by removing a part of the frame unit.

2. The helmet shield of claim 1, wherein at least a part of the ventilation hole extends from the inside of the helmet shield to the outside of the helmet shield at a direction facing away from the front portion of the lens unit.

3. The helmet shield of claim 1, wherein a width of the cover unit becomes narrower toward the guide hole.

4. The helmet shield of claim 1, wherein the cover unit includes:

frame unit connectors provided at an upper side of the cover unit and a lower side of the cover unit for connection to the frame unit;

wherein the lens unit connector has: a height equal to a height of the side edge of the lens unit and a width equal to a width of the side edge of the lens unit, the side edge of the lens unit located adjacent to the cover unit.

5. The helmet shield of claim 1, wherein a surface of the second lens unit is anti fog-treated.

6. The helmet shield of claim 1, further comprising a heat transfer unit for generating heat to prevent condensation on an outer surface of the second lens, wherein the heat transfer unit includes:

a heat transfer line, supplied with power, for generating heat;

a power input unit, provided in the frame unit, for transferring power to the heat transfer line; and an electric wire for connecting the power input unit with the heat transfer line.

* * * * *